US010663264B1

(12) United States Patent
Spradlin, Sr.

(10) Patent No.: US 10,663,264 B1
(45) Date of Patent: May 26, 2020

(54) BALLISTIC PROTECTION SYSTEM

(71) Applicant: Robert C. Spradlin, Sr., Brownstown, MI (US)

(72) Inventor: Robert C. Spradlin, Sr., Brownstown, MI (US)

( * ) Notice: Subject to any disclaimer, the term of this patent is extended or adjusted under 35 U.S.C. 154(b) by 0 days.

(21) Appl. No.: 16/268,851

(22) Filed: Feb. 6, 2019

(51) Int. Cl.

| | |
|---|---|
| ***F41H 5/013*** | (2006.01) |
| ***F41H 5/02*** | (2006.01) |
| ***F41H 5/06*** | (2006.01) |
| *F41H 5/24* | (2006.01) |
| *F41H 5/04* | (2006.01) |

(52) U.S. Cl.
CPC ..... *F41H 5/013* (2013.01); *F41H 5/02* (2013.01); *F41H 5/06* (2013.01); *F41H 5/04* (2013.01); *F41H 5/24* (2013.01)

(58) Field of Classification Search
CPC ... F41H 5/013; F41H 5/02; F41H 5/06; F41H 5/04; F41H 5/24
USPC ..... 89/36.02, 36.04, 36.07; 297/188.02
See application file for complete search history.

(56) References Cited

U.S. PATENT DOCUMENTS

| | | | | |
|---|---|---|---|---|
| 5,180,880 | A | 1/1993 | Zufle | |
| 5,448,938 | A | 9/1995 | Fernandez et al. | |
| 5,554,816 | A * | 9/1996 | Skaggs | F41H 5/08 109/49.5 |
| 5,806,925 | A | 9/1998 | Hanley | |
| 6,164,181 | A | 12/2000 | Bruner | |
| 7,988,237 | B2 | 8/2011 | Peters | |
| 8,418,595 | B1 * | 4/2013 | Saucedo | F41H 5/26 89/36.01 |
| 8,500,186 | B2 * | 8/2013 | Warren | B60J 1/2011 296/97.5 |
| 8,671,820 | B1 * | 3/2014 | Keyfauver | F41H 5/08 89/36.05 |
| 9,335,128 | B2 | 5/2016 | Wemhoener et al. | |
| 10,330,443 | B2 * | 6/2019 | Wemhoener | A47C 1/00 |
| 2004/0144244 | A1 | 7/2004 | Sargent | |
| 2006/0243126 | A1 | 11/2006 | Tyler | |
| 2010/0107861 | A1 | 5/2010 | Carter | |
| 2012/0118135 | A1 * | 5/2012 | Warren | B60J 1/2011 89/36.02 |
| 2012/0152096 | A1 * | 6/2012 | Peters | F41H 5/06 89/36.01 |

(Continued)

FOREIGN PATENT DOCUMENTS

| | | | |
|---|---|---|---|
| DE | 7806111 | U | 6/1978 |
| WO | 2012138322 | A1 | 10/2012 |

OTHER PUBLICATIONS

Coverking. "Tactical Custom Seat Covers," 2018, Downloaded from https://www.coverking.com/tactical/.

(Continued)

*Primary Examiner* — Samir Abdosh
(74) *Attorney, Agent, or Firm* — Carlson, Gaskey & Olds, P.C.

(57) ABSTRACT

A ballistic protection system according to an example of the present disclosure includes a sleeve having first and second layers defining a cavity therebetween, with an opening providing access to the cavity. A ballistic protection layer is disposed in the cavity, and is removable through the opening. A holder is operable to mount the sleeve to an article. The second layer is disposed between the holder and the ballistic protection layer.

21 Claims, 7 Drawing Sheets

(56) References Cited

U.S. PATENT DOCUMENTS

2012/0167752 A1* 7/2012 Buckner ..... B42F 9/002 89/36.02
2012/0174768 A1* 7/2012 Spransy ..... F41H 5/013 89/36.09
2012/0180636 A1* 7/2012 Seuk ..... F41H 5/08 89/36.07
2012/0248837 A1* 10/2012 Peters ..... A47C 3/04 297/239
2014/0060299 A1* 3/2014 Peters ..... A47C 3/04 89/36.01
2014/0084646 A1 3/2014 Benden
2014/0208993 A1* 7/2014 Spransy ..... E05G 5/003 109/50
2015/0260484 A1* 9/2015 Peters ..... A45B 25/02 89/36.02
2016/0178329 A1* 6/2016 Gibson ..... F41H 5/06 89/36.02
2016/0216079 A1* 7/2016 Wemhoener ..... A47C 1/00
2016/0242547 A1 8/2016 Isquith
2016/0273883 A1 9/2016 Weekly
2018/0023927 A1* 1/2018 Wemhoener ..... A47C 1/00 297/188.04
2018/0049554 A1 2/2018 Igbinevbo
2018/0372455 A1* 12/2018 Klassen ..... G09F 23/00

OTHER PUBLICATIONS

Coverking. "Coverking Cordura Ballistic Seat Covers," date of download Dec. 9, 2018. Downloaded from https://www.autoanything.com/seat-covers/75A4643A0A0.aspx.

K9 Ballistics. "K9 Ballistic Rectangle Tough Cover," date of download Dec. 10, 2018. Downloaded from k9ballistics.com/index.php/rectangle-tuff-cover.html. Copyrights 2010-2018 K9 Dog Beds, Inc.

* cited by examiner

BALLISTIC PROTECTION SYSTEM

BACKGROUND

This application relates to ballistic protection, and more particularly to a ballistic protection system including a sleeve that is mountable to an article such as furniture.

As active shooter situations become more common, there is an increased desire for ballistic protection from such shooters. Some furniture manufacturers have created furniture with built in ballistic protection layers. However, this does not address the large number of existing pieces of furniture that lack such protection.

SUMMARY

A ballistic protection system according to an example of the present disclosure includes a sleeve having first and second layers defining a cavity therebetween, with an opening providing access to the cavity. A ballistic protection layer is disposed in the cavity, and is removable through the opening. A holder is operable to mount the sleeve to an article. The second layer is disposed between the holder and the ballistic protection layer.

A further embodiment of any of the foregoing embodiments includes a flap that extends over the opening to conceal the opening and the ballistic protection layer, and that is removably secured to the first layer.

A further embodiment of any of the foregoing embodiments includes a third layer, where the second layer is disposed between the first and third layers. The holder includes a pocket formed between the second and third layers for receiving a portion of the article.

In a further embodiment of any of the foregoing embodiments, an area of the third layer is smaller than an area of the first and second layers.

In a further embodiment of any of the foregoing embodiments, the sleeve includes opposing first and second ends, and the opening is disposed along the first end.

In a further embodiment of any of the foregoing embodiments, an opening to the pocket is disposed between the first end and the second end of the sleeve at a location that is closer to the first end than to the second end.

A further embodiment of any of the foregoing embodiments includes a strap that extends across the second layer along an exterior of the sleeve. The strap is disposed at a location that is closer to the second end than to the first end.

In a further embodiment of any of the foregoing embodiments, the ballistic protection layer is contoured and includes a convex section, a concave section, or both.

In a further embodiment of any of the foregoing embodiments, the holder includes a strap having opposing first and second ends. The first end of the strap is mounted to the sleeve, and the strap includes a fastener proximate to an opposing second end of the strap for mounting the sleeve to the article.

A method of providing ballistic protection according to an example of the present disclosure includes inserting a ballistic protection layer through an opening in a sleeve into a cavity provided between first and second layers of the sleeve, and mounting a holder of the sleeve to a piece of furniture such that a portion of the piece of furniture is disposed between the holder and the ballistic protection layer.

In a further embodiment of any of the foregoing embodiments, the sleeve includes opposing first and second ends, and the ballistic protection layer is inserted through the opening at the first end of the sleeve.

In a further embodiment of any of the foregoing embodiments, mounting the holder of the sleeve to the piece of furniture includes inserting a portion of the piece of furniture into a pocket of the sleeve, such that the pocket and the cavity are disposed on opposing sides of the second layer.

In a further embodiment of any of the foregoing embodiments, inserting the portion of the piece of furniture into the pocket includes inserting the portion of the piece of furniture into a second opening that is disposed between the first and second ends at a location that is closer to the first end than to the second end.

A further embodiment of any of the foregoing embodiments includes covering the opening with a flap that is secured to the sleeve.

A further embodiment of any of the foregoing embodiments includes, while the flap covers the opening, removably securing the flap to the first layer.

In a further embodiment of any of the foregoing embodiments, the portion of the piece of furniture is a first portion, and the method includes securing the sleeve to a second portion of the piece of furniture that is different from the first portion using a strap, such that the second portion of the piece of furniture is disposed between the strap and the sleeve.

In a further embodiment of any of the foregoing embodiments, mounting the holder includes mounting the sleeve to a chair.

A further embodiment of any of the foregoing embodiments, mounting the holder includes mounting the sleeve to a door.

A further embodiment of any of the foregoing embodiments, mounting the holder includes mounting the sleeve to a dry erase board or chalk board.

A ballistic protection system according to an example of the present disclosure includes a sleeve having first and second layers, and defining a cavity therebetween. The sleeve has an opening that provides access to the cavity. A ballistic protection layer is disposed in the cavity. A flap extends over the opening to conceal the opening and a fastener location for mounting the flap to an article.

The embodiments, examples, and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
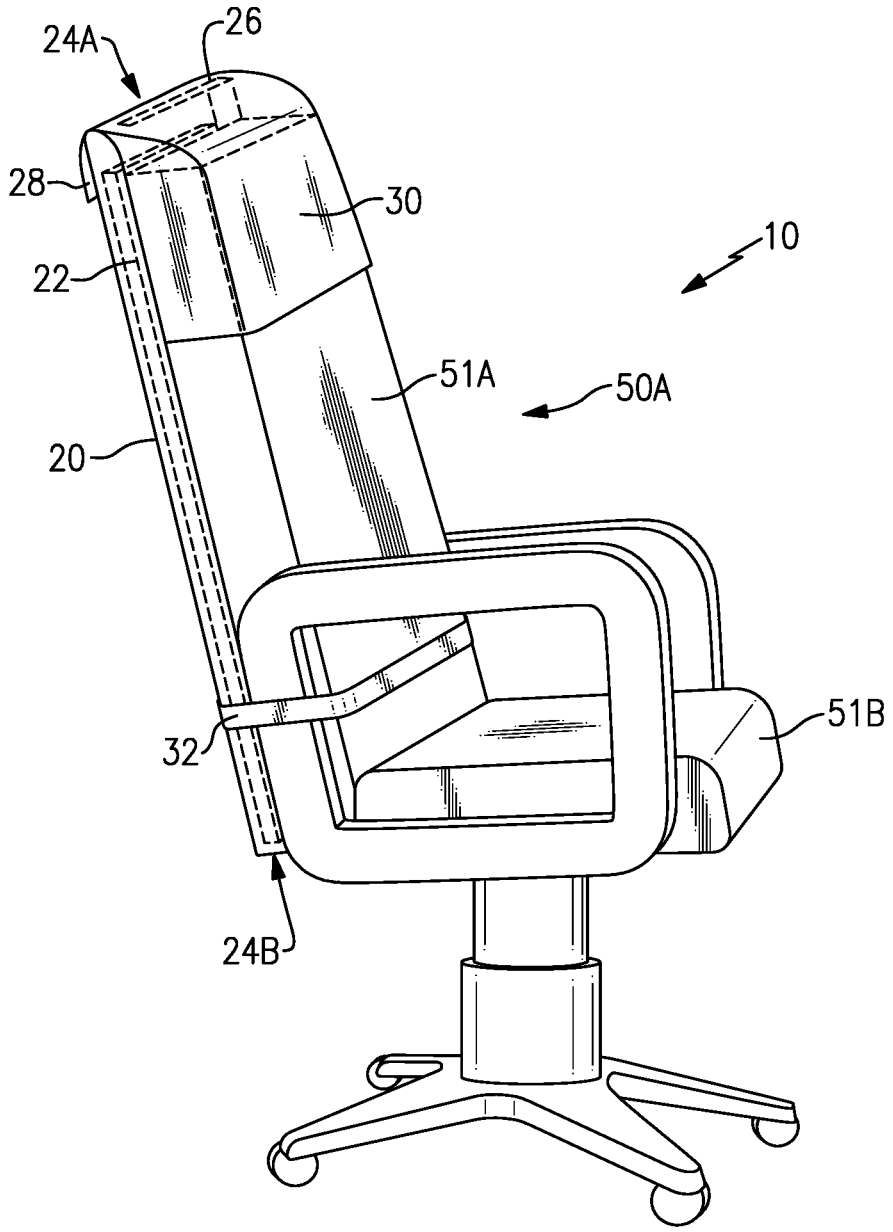
FIG. 1 is a perspective view of an example ballistic protection system which includes a sleeve mounted to a desk chair.

FIG. 1 illustrates a perspective view of an example ballistic protection system 10, which includes a sleeve 20 and a ballistic protection layer 22 disposed within the sleeve 20. A holder 30 is operable to mount the sleeve 20 to an article 50A, which in the case of FIG. 1 is a desk chair having a back 51A and a seat 51B.

The sleeve 20 includes a first end 24A and an opposing second end 24B. The ballistic protection layer 22 is received into a cavity within the sleeve 20 through an opening 26 disposed proximate to and/or along the first end 24A. A flap 28 extends over the opening 26 to conceal the opening 26 and to conceal an end of the ballistic protection layer 22. The ballistic protection layer 22 is removable through the opening 26 when the flap 28 is opened. In one example, in addition to or instead of including the flap 28, the sleeve 20 includes a zipper to open and close the opening 26.

A strap 32 extends across the sleeve 20 and is disposed at a location that is closer to the second end 24B than to the first end 24A. In addition to the holder 30 mounting the sleeve 20 to the article 50A, the strap 32 serves as an additional mounting mechanism.

The ballistic protection layer 22 may include one of the ballistic protection sheets sold by AMULET Ballistic Barriers, such as their AMULET 1, AMULET 2, or AMULET 3 barriers, for example, which each offer differing degrees of ballistic protection. Of course, it is understood that these are non-limiting examples and that other ballistic protection layers could be used. Because the ballistic protection layer 22 is removable from the sleeve 20, the ballistic protection layer 22 can easily be switched out for a different grade of ballistic protection.

In one example, the ballistic protection system 10 includes the article 50. In another example, although the sleeve 20 is suitable for mounting to the article 50, the article 50 itself is not part of the ballistic protection system 10.

Figure 2:
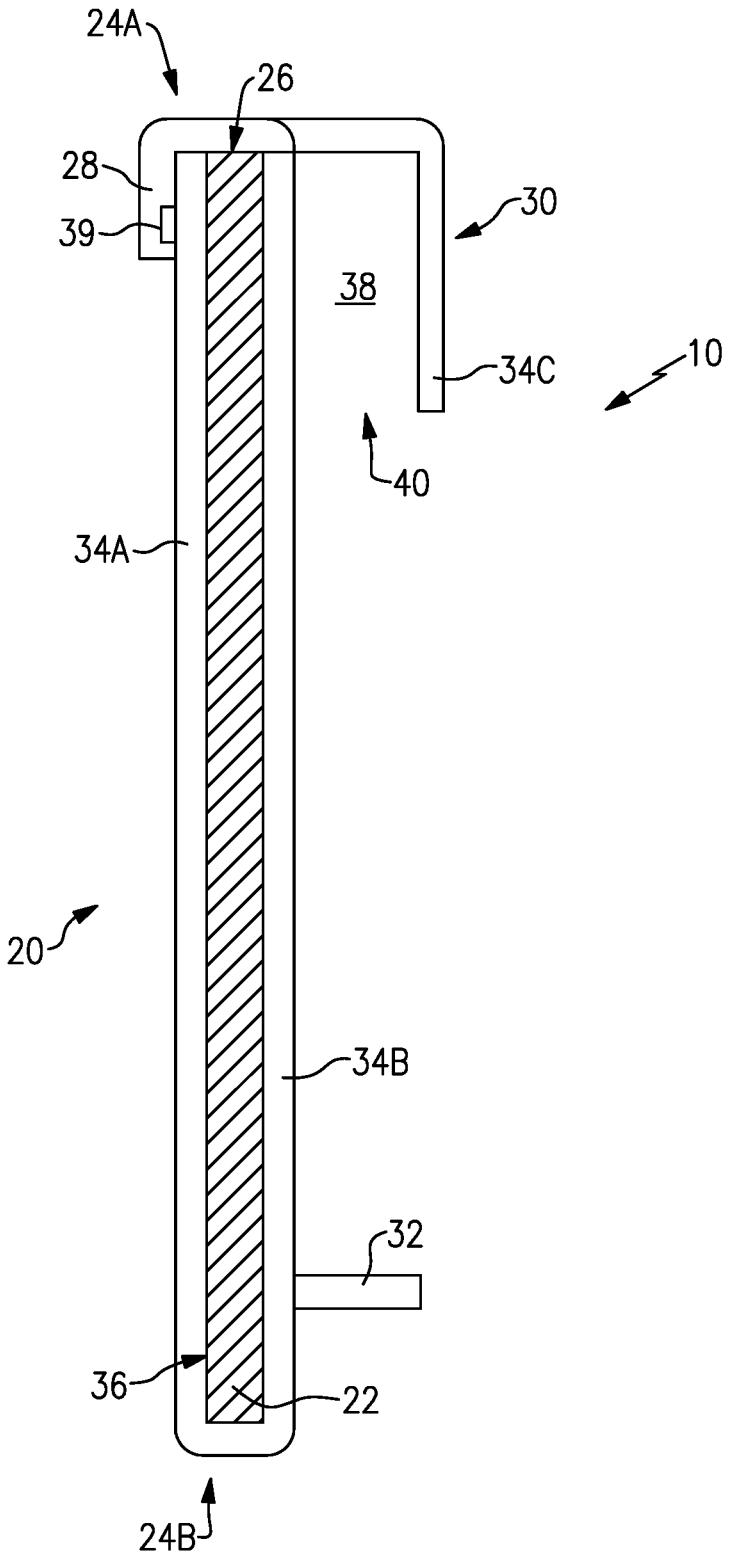
FIG. 2 is a cross-sectional view of the sleeve of FIG. 1.

FIG. 2 illustrates a cross-sectional view of the sleeve 20 of FIG. 1. As shown in FIG. 2, the sleeve 20 includes a first layer 34A, a second layer 34B, and a third layer 34C. A cavity 36 is disposed between the first and second layers 34A-B, and the ballistic protection layer 22 is disposed within the cavity 36. The opening 26 at the first end 24A of the sleeve 20 provides access to the cavity 36, and the sleeve receives the ballistic protection layer 22 through the opening 26. As shown in FIG. 2, the flap 28 extends over the opening 26 to conceal the opening 26 and an end of the ballistic protection layer 22. The flap 28 is removably secured to the first layer 34A through a fastener 39, which may be a hook and loop fastener or a snap fastener, for example.

The second layer 34B is disposed between the first layer 34A and the third layer 34C. In the example of FIG. 2, the holder 30 is a pocket formed between the second layer 34B and the third layer 34C for receiving a portion of the article 50. The pocket 30 includes a cavity 38 and an opening 40 for receiving a portion of the article 50 into the cavity 38. The opening 40 to the pocket 30 is disposed between the first and second ends 24A-B at a location that is closer to the first end 24A than to the second end 24B. The strap 32 shown in FIG. 1, if provided, extends across the second layer 34B along an exterior of the sleeve 20, and can be used to further secure the sleeve 20 to the article 50 when a portion of the article 50 is disposed between the strap 32 and the sleeve 20. The strap 32 is disposed at a location that is closer to the second end 24B than to the first end 24A.

Because the sleeve 20 is removable from the article 50 to which it is secured, it is suitable for carrying on one's person for ballistic protection if one wanted to retreat from a location of the article 50. Also, the removability of the ballistic protection layer 22 from the opening 26 of the sleeve 20 makes it easy to clean the sleeve 20, for example in a washing machine, which may not be possible if the ballistic protection layer 22 were permanently provided within the sleeve 20. Moreover, as discussed above, different ballistic protection layers could be swapped out for different levels of desired protection by utilizing the removability of the ballistic protection layer 22 through the opening 26. The convenient insertability/removability of the ballistic protection layer 22 through the opening 26 also makes it convenient to assemble the ballistic protection system 10 on-site, such that a plurality of sleeves 20 and ballistic protection layers (e.g., which provide varying degrees of ballistic protection) could be shipped and assembled and mounted to articles on-site.

Figure 3B:
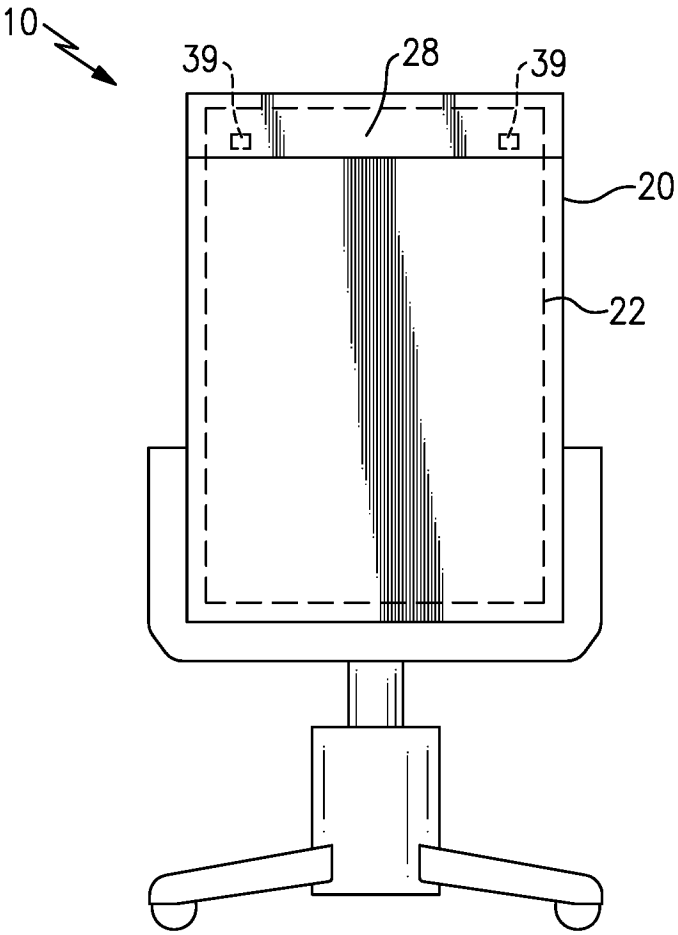
FIG. 3B illustrates a rear view of the ballistic protection system of FIG. 1 with the flap lowered.
Figure 3A:
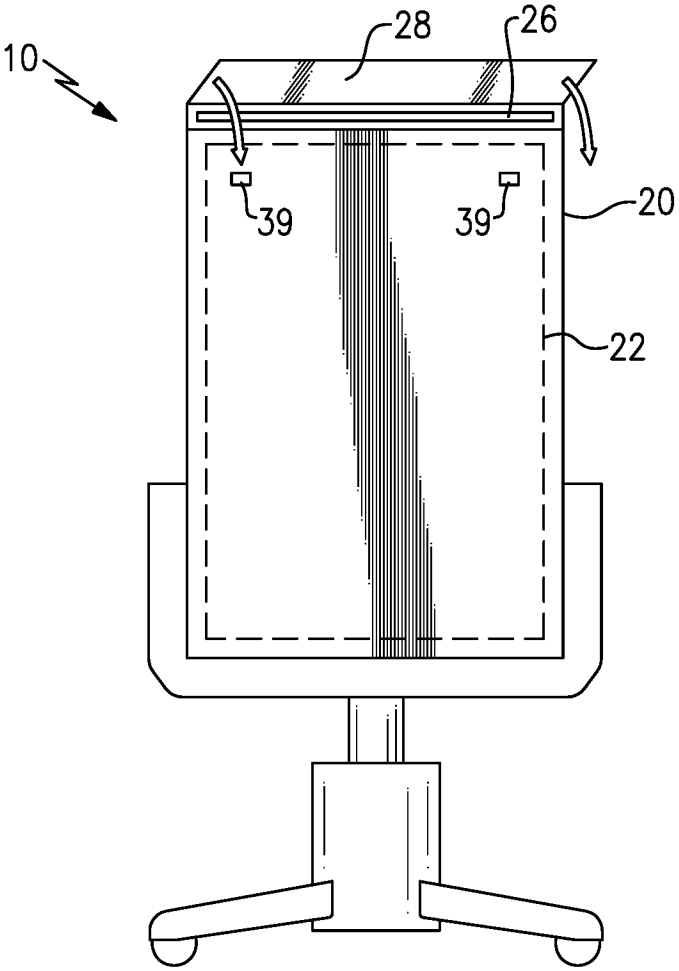
FIG. 3A illustrates a rear view of the ballistic protection system of FIG. 1 with a flap raised.

FIG. 3A illustrates a rear view of the ballistic protection system 10 which shows the flap 28 in a lifted position, in which the opening 26 is exposed and the ballistic protection layer 22 can be removed.

FIG. 3B, in contrast, shows the rear view of FIG. 3A but where the flap 28 is in a closed position and is fastened via fasteners 39. In the example of FIG. 3B, the opening 26 and end of the ballistic protection layer 22 are concealed.

Figure 3C:
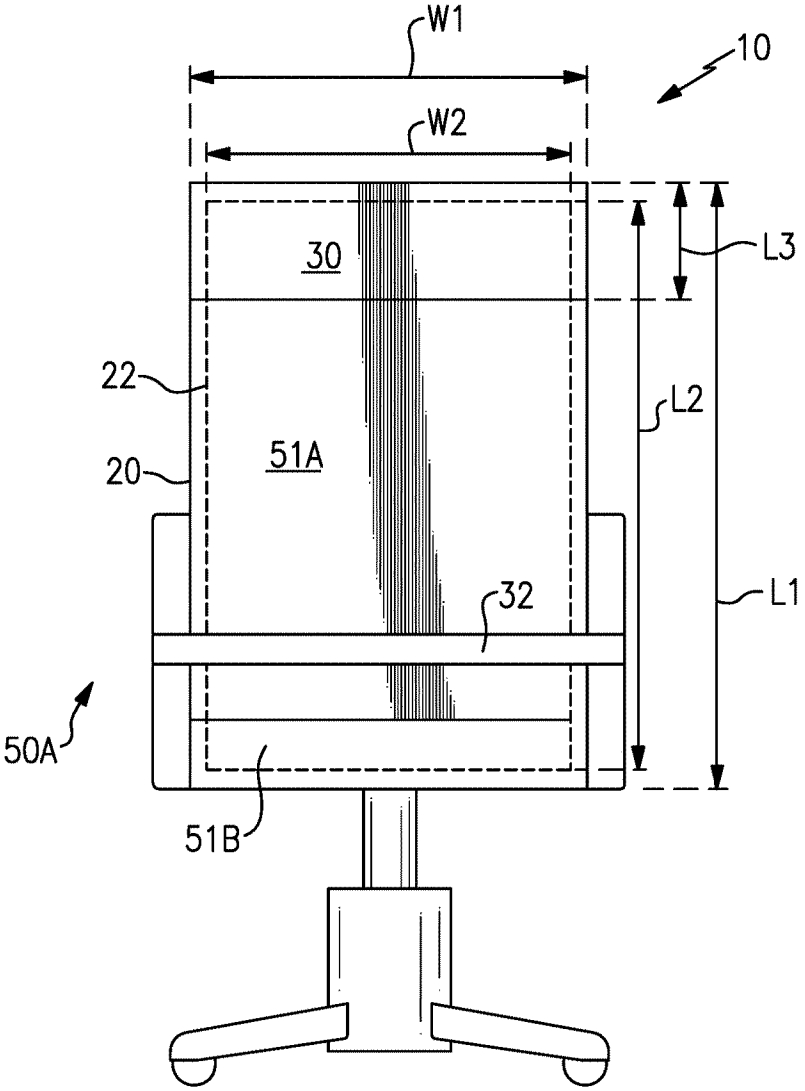
FIG. 3C illustrates a front view of the ballistic protection system of FIG. 1.

FIG. 3C shows a front view of the ballistic protection system 10. As shown in FIG. 3C, the sleeve 20 and the holder 30 have a width W1. The sleeve 20 has a length L1 and the holder 30 has a length L3 that is less than the length L1. Thus, in the example of FIG. 3C, an area A1 of the sleeve 20 (which is spanned by the width W1 and the length L1) is greater than an area A3 of the pocket 30 (which is spanned by the width W1 and the length L3). Referring to FIG. 2 with continued reference to FIG. 3C, because the pocket 30 is formed by layer 34C and sleeve 20 includes layers 34B and 34A, an area of the third layer 34C is smaller than the area of each of the first layer 34A and the second layer 34B. As shown in FIG. 3C, the width W1 of the holder 30 is greater than the length L3 of the holder 30.

In the example of FIG. 3, the ballistic protection sheet has a length L2 which is larger than the length L3 of the holder 30, and has a width W2 that is slightly smaller than the width W1 of the pocket 30. Here too, an area A2 of the ballistic protection sheet 22 (which is spanned by the width W2 and the length L2) is larger than an area of the pocket 30 (which is spanned by the width W1 and the length L3).

In this disclosure, like reference numerals designate like elements where appropriate and reference numerals with the addition of one hundred or multiples thereof designate modified elements that are understood to incorporate the same features and benefits of the corresponding elements.

Figure 4:
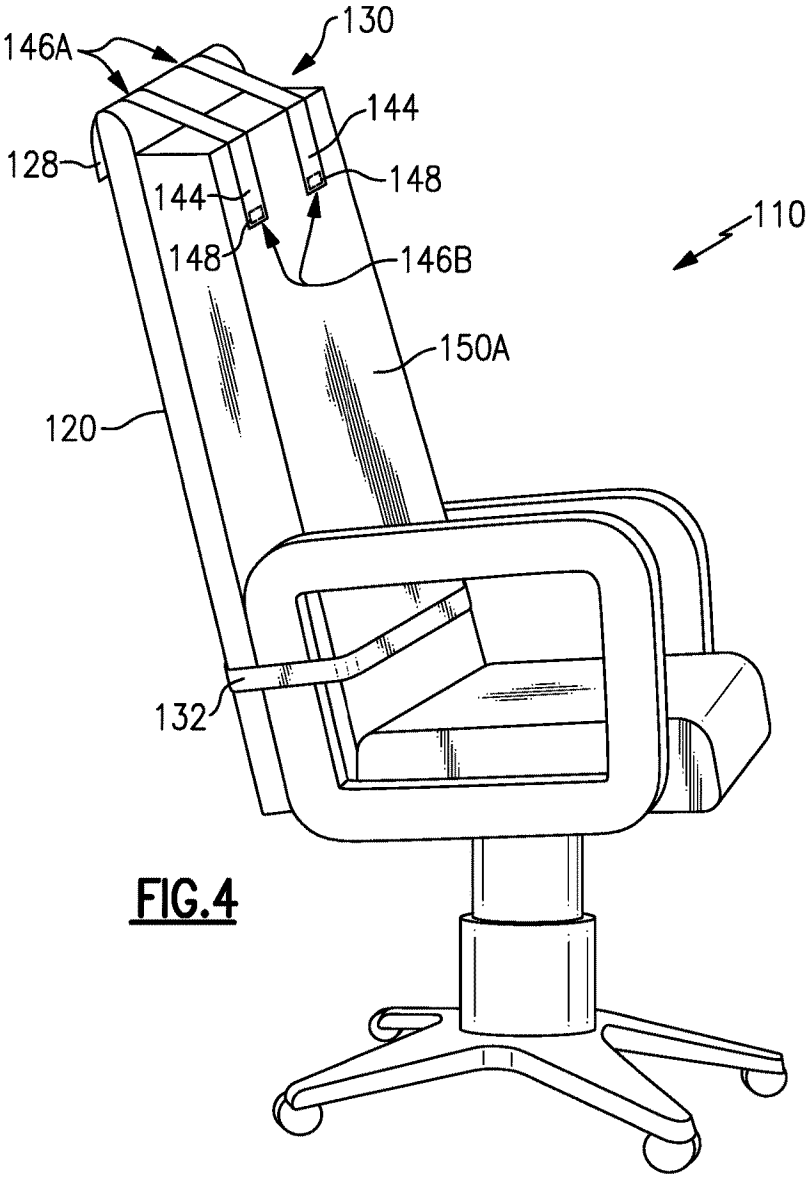
FIG. 4 is a perspective view of another example ballistic protection system which includes a sleeve mounted to a desk chair.

FIG. 4 is a perspective view of a ballistic protection system 110 with a holder 130. Instead of defining a pocket cavity, the holder 130 includes a plurality of straps 144 that can be secured to the article 50A. Each strap 144 includes a first end 146A and an opposing second end 146B. The first end 146A of each strap 144 is mounted to the sleeve 120, and a fastener 148 is provided proximate to the second end 146B of each strap 144 for mounting the strap 144 to the article 50. The fastener 148 may include a hook and loop fastener, or snap fastener, for example. Like the ballistic protection system 10, a flap 128 and strap 132 are also provided.

Although a desk chair has been discussed above as an example article 50, it is understood that this is only an example, and that the ballistic protection system 10 may mount the sleeve 20/120 to different types of articles 50 as well.

Figure 5:
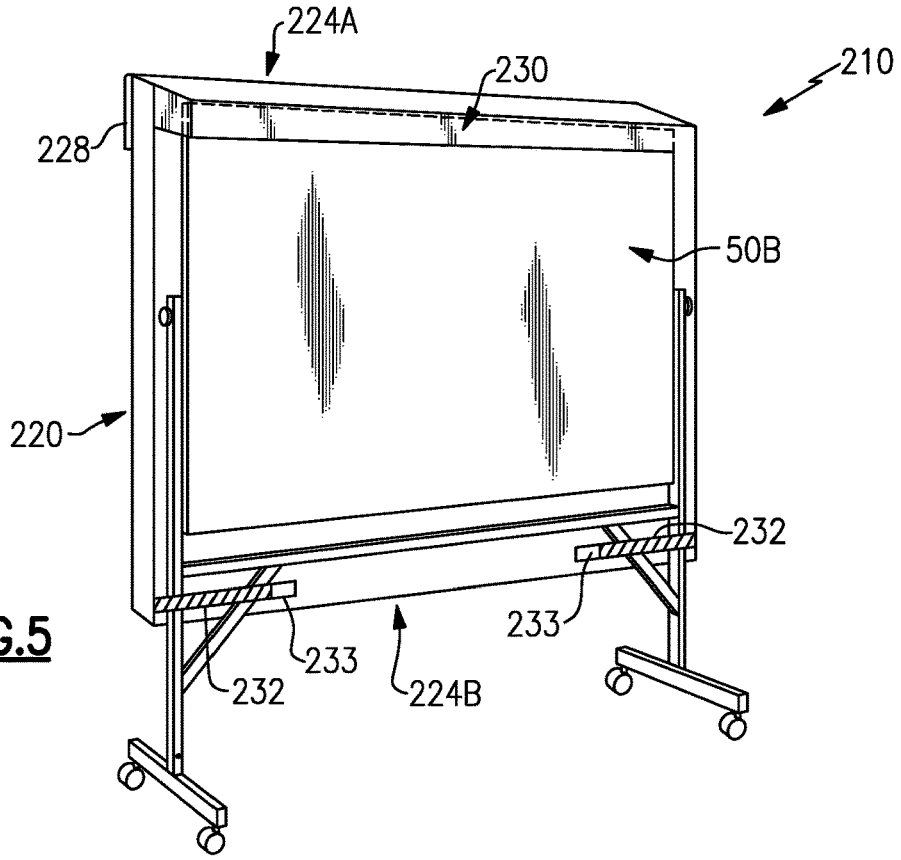
FIG. 5 is a perspective view of an example ballistic protection system which includes a sleeve mounted to a dry erase board.

FIG. 5 illustrates an example ballistic protection system 210 in which the article 50B is a board for use as a chalk board or dry erase board. The ballistic protection system 210 of FIG. 5 includes a sleeve 220 having opposing first and second ends 224A-B, a holder 230, and a flap 228. The flap 228 conceals a ballistic protection layer within the sleeve 220 (not shown). The holder 230 in the example of FIG. 5 provides a pocket into which a portion of the board 50B is received. Of course, it is understood that this is only an example, and that other holders could be used, such as strap-style holder 130 shown in FIG. 4. Straps 232 are provided proximate to end 224B of the sleeve 220 for further mounting sleeve 220 to the article 50B. Each strap 232 includes a fastener 233 for securing the strap 232 to a surface of the sleeve 220. The fastener 233 may include a buckle, a hook and loop fastener or a snap fastener, for example. Although not depicted in FIG. 1 or 4, it is understood that a buckle could be used with the strap 32, 132 in those examples as well.

Figure 6:
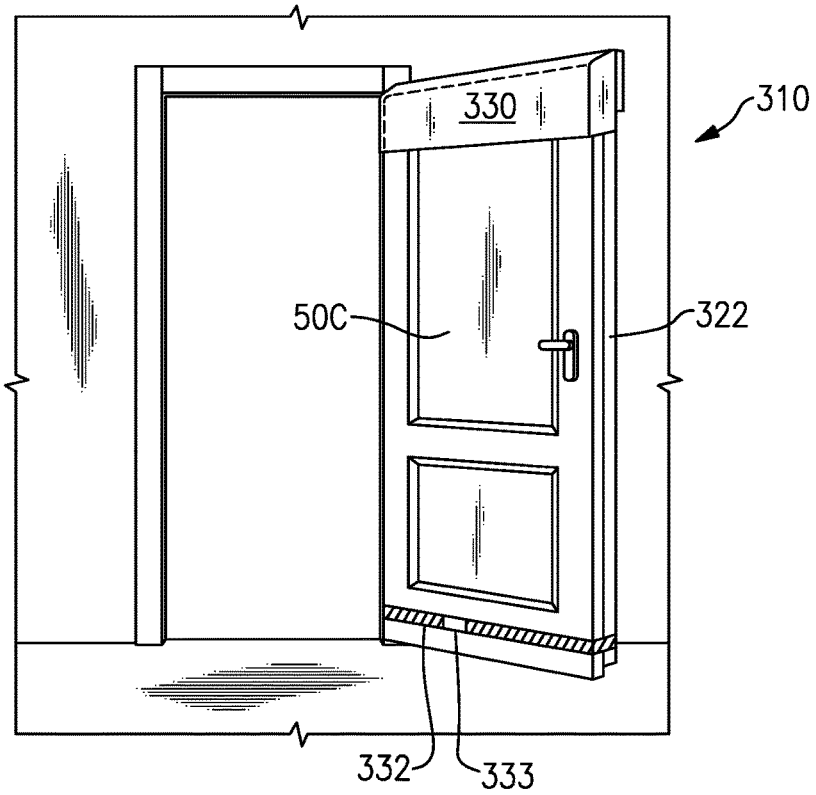
FIG. 6 is a perspective view of an example ballistic protection system which includes a sleeve mounted to a door.

FIG. 6 illustrates an example ballistic protection system 310 in which the article 50C is a door. A pocket 330 at a first end 324A of the sleeve 320 receives a portion of the top of the door 50C, and a strap 332 provided proximate to an opposite second end 324B of the door 50C is provided for further securing the sleeve 322 to the door 50C. A fastener 333 (e.g., of any of the types discussed above) may optionally be provided for securing the strap 332 around the door 50C.

In the examples discussed above, a generally planer ballistic protection layer is suitable for use because the various articles 50 have a generally planer surface to which the sleeve 20/120/220/320 is affixed. However, certain articles have surface contours, and for such articles 50 a molded ballistic protection layer 22 may be provided which includes one or more contours, and includes a convex section, a concave section, or both.

Figure 7:
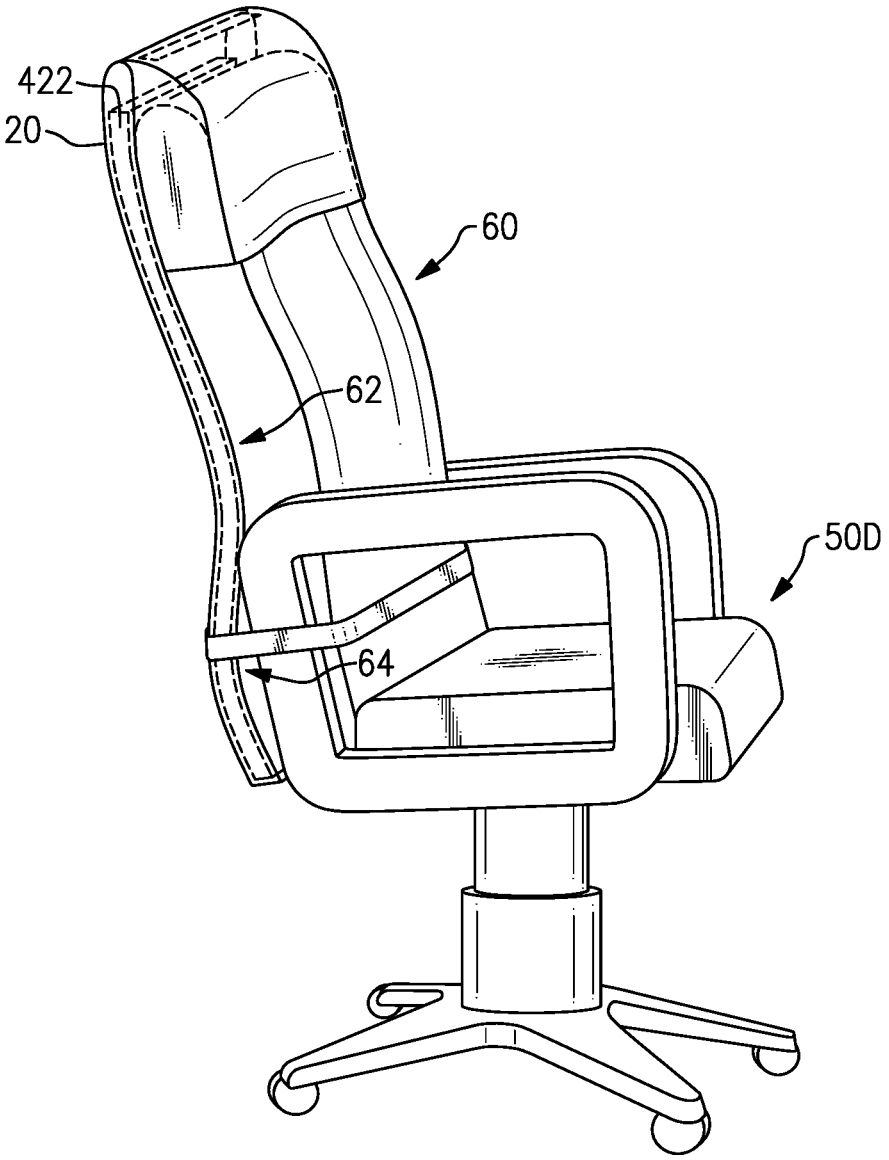
FIG. 7 is a perspective view of an example ballistic protection system with a contoured ballistic protection layer.

FIG. 7 shows an article 50D, which is a desk chair having a contoured back 60. The sleeve 20 discussed in FIG. 1 is provided, but instead of using a planar ballistic protection layer 22, a contoured ballistic protection sheet 422 is provided, which is contoured in a manner that corresponds to the back 60. In the example of FIG. 7, a portion 62 of the ballistic protection sheet 422 is convex with respect to the back 60 and a portion 64 of the ballistic protection sheet 422 is concave with respect to the back 60.

Figure 8A:
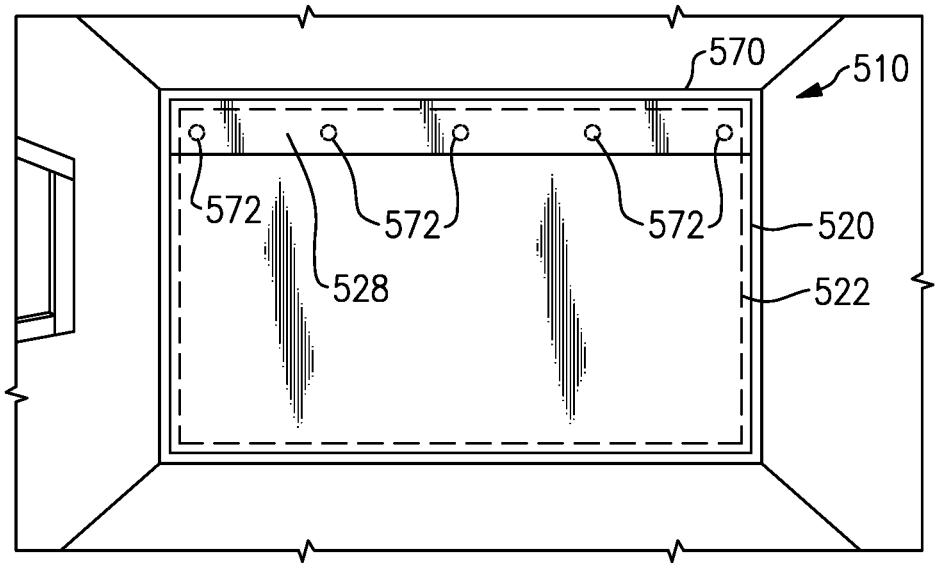
FIG. 8A illustrates an example ballistic protection system which includes a sleeve mounted to a wall.

FIG. 8A illustrates an example ballistic protection system 510 that provides ballistic protection for a wall 570 of a room. A ballistic protection sleeve 520 is provided having an internal cavity in which a ballistic protection layer 522 is disposed. A plurality of fastener locations 572 are provided for securing the sleeve 520 and ballistic protection layer 522 to the wall 570. Flap 528 is provided to cover the fastener locations 572 and an opening that provides access to the internal cavity.

Figure 8B:
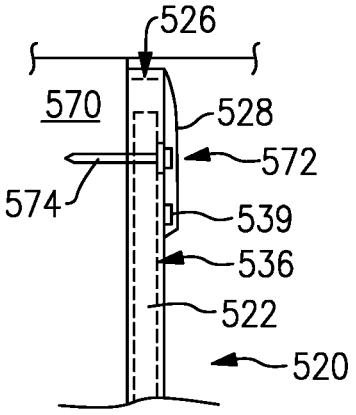
FIG. 8B is a cross-sectional view of the ballistic protection system of FIG. 8A.

FIG. 8B shows a cross-sectional view of the sleeve 522 and shows an opening 526 in the sleeve 520 which provides access to the cavity 536 into which the ballistic protection layer 522 is received. In this embodiment, the holder 30 is omitted and the flap 528 covers the opening 526 and a plurality of fasteners 574 disposed at the fastener locations 572 which extend through at least the ballistic protection layer 522 and the sleeve 520 into the wall 570. The sleeve 520 can provide an inexpensive way of providing ballistic protection to a wall which is already formed without requiring providing the ballistic protection layer 522 within the wall.

Although example embodiments have been disclosed, a worker of ordinary skill in this art would recognize that certain modifications would come within the scope of this disclosure. For that reason, the following claims should be studied to determine the scope and content of this disclosure.

What is claimed is:

1. A ballistic protection system, comprising:

a sleeve including opposing first and second ends, and including first and second layers defining a cavity therebetween, an opening providing access to the cavity;

a ballistic protection layer disposed in the cavity, and removable through the opening;

a holder disposed at the first end of the sleeve and operable to mount the sleeve to an article, the second layer disposed between the holder and the ballistic protection layer, wherein a width of the holder measured between opposing first and second sides of the sleeve is greater than a length of the holder measured between the opposing first and second ends of the sleeve; and a strap that is separate from the holder and extends across the second layer along an exterior of the sleeve, the strap disposed at a location that is closer to the second end of the sleeve than to the first end.

2. The ballistic protection system of claim 1, comprising a flap that extends over the opening to conceal the opening and the ballistic protection layer, and that is removably secured to the first layer.

3. The ballistic protection system of claim 1, comprising:

a third layer, the second layer disposed between the first and third layers;

wherein the holder comprises a pocket formed between the second and third layers for receiving a portion of the article.

4. The ballistic protection system of claim 3, wherein an area of the third layer is smaller than an area of the first and second layers.

5. The ballistic protection system of claim 3, wherein the opening is disposed along the first end of the sleeve.

6. The ballistic protection system of claim 5, wherein an opening to the pocket is disposed between the first end and second end of the sleeve at a location that is closer to the first end than to the second end.

7. The ballistic protection system of claim 1, wherein the ballistic protection layer is contoured and includes a convex section, a concave section, or both.

8. A ballistic protection system, comprising:

a sleeve including first and second layers defining a cavity therebetween, an opening providing access to the cavity, the sleeve having opposing first and second ends;

a ballistic protection layer disposed in the cavity, and removable through the opening;

a holder operable to mount the first end of the sleeve to an article in a mounting position, the holder comprising at least one first strap, each first strap having opposing first and second strap ends, the first strap end mounted to the first end of the sleeve, and each first strap including a fastener proximate to the second strap end for mounting the sleeve to the article; and a second strap that is separate from the holder and the at least one first strap, the second strap extending across the second layer along an exterior of the sleeve, the second strap disposed at a location that is closer to the second end of the sleeve than to the first end.

9. A method of providing ballistic protection, comprising:

inserting a ballistic protection layer through an opening in a sleeve into a cavity provided between first and second layers of the sleeve; and mounting a holder of the sleeve to a piece of furniture such that a portion of the piece of furniture is disposed between the holder and the ballistic protection layer.

10. The method of claim 9, wherein:

the sleeve includes opposing first and second ends; and said inserting a ballistic protection layer through an opening in a sleeve comprises inserting the ballistic protection layer into the opening at the first end of the sleeve.

11. The method of claim 9, wherein said mounting a holder of the sleeve to a piece of furniture comprises inserting a portion of the piece of furniture into a pocket of the sleeve, such that the pocket and the cavity are disposed on opposing sides of the second layer.

12. The method of claim 9, wherein said inserting a portion of the piece of furniture into the pocket comprises inserting the portion of the piece of furniture into a second opening that is disposed between the first and second ends at a location that is closer to the first end than to the second end.

13. The method of claim 9, comprising covering the opening with a flap that is secured to the sleeve.

14. The method of claim 13, comprising, while the flap covers the opening, removably securing the flap to the first layer.

15. The method of claim 9, wherein the portion of the piece of furniture is a first portion, the method comprising:

securing the sleeve to a second portion of the piece of furniture that is different from the first portion using a strap, such that the second portion of the piece of furniture is disposed between the strap and the sleeve.

16. The method of claim 9, wherein said mounting a holder of the sleeve to a piece of furniture comprises mounting the sleeve to a chair.

17. The method of claim 9, wherein said mounting a holder of the sleeve to a piece of furniture comprises mounting the sleeve to a door.

18. The method of claim 9, wherein said mounting a holder of the sleeve to a piece of furniture comprises mounting the sleeve to a dry erase board or chalk board.

19. A ballistic protection system, comprising:

a sleeve having first and second layers, and defining a cavity therebetween, the sleeve having a first opening that provides access to the cavity, and a plurality of pairs of second openings that are separate from the first opening, each pair of openings including an opening in the first layer and an opening in the second layer for receiving a fastener that extends through the pair of openings for mounting the sleeve to an article outside of the cavity;

a ballistic protection layer disposed in the cavity; and a flap that extends over the first opening and the plurality of pairs of second openings to conceal both the first opening and plurality of pairs of second openings.

20. The ballistic protection system of claim 8, wherein in the mounting position the second layer is disposed between the ballistic protection layer and at least a portion of the strap, and the strap extends from a first end of the sleeve towards a second end of the sleeve.

21. The ballistic protection system of claim 3, wherein the pocket terminates at the first end.

* * * * *